United States Patent [19]

Bossetti

[11] 4,154,576

[45] May 15, 1979

[54] OVEN FOR FIRING CERAMIC MATERIALS, HAVING HIGH THERMAL EFFICIENCY

[75] Inventor: Renato Bossetti, Novara, Italy

[73] Assignee: S.I.T.I. Soc. Imp. Termoelettrici Indistriali S.A.S., Marano Ticino, Italy

[21] Appl. No.: 835,013

[22] Filed: Sep. 20, 1977

[30] Foreign Application Priority Data

Oct. 5, 1976 [IT] Italy ..... 27995 A/76
Jun. 30, 1977 [IT] Italy ..... 25228 A/77

[51] Int. Cl.[2] ..... F27B 9/02
[52] U.S. Cl. ..... 432/128; 432/130; 432/148; 432/246
[58] Field of Search ..... 432/128, 130, 132, 147, 432/148, 150, 236, 246

[56] References Cited

U.S. PATENT DOCUMENTS

| | | | |
|---|---|---|---|
| 1,938,581 | 12/1933 | Cope et al. | 432/236 |
| 3,208,740 | 9/1965 | Nesbitt et al. | 432/147 |
| 3,540,705 | 11/1970 | Hoffman | 432/236 |
| 4,009,993 | 3/1977 | Marazzi | 432/246 |

FOREIGN PATENT DOCUMENTS

| | | | |
|---|---|---|---|
| 1186831 | 9/1959 | France | 432/246 |

*Primary Examiner*—John J. Camby
*Attorney, Agent, or Firm*—Wenderoth, Lind & Ponack

[57] ABSTRACT

The oven according to the invention comprises a plurality of heated superimposed channels and a plurality of rollers for supporting and advancing the ceramic materials, generally tiles, arranged transversely in each channel and closer to the ceiling than to the floor of the channel. Preferably the distance of the roller axes from the channel floor is not less than twice the pitch of the rollers and their distance from the channel ceiling is not more than such pitch. Preferably the channels are each constituted by a plurality of laterally juxtaposed chambers separated by partitions, the rollers extending through the channels without engaging the partitions. The superimposed adjacent channels are preferably separated by hollow slabs and slabs are located above the highest and below the lowest channels, hot gases being introduced into the cavities within the slabs and flowing out through apertures in the slabs to heat the tiles, or electrical resistances are provided in the slabs. These latter are advantageously constituted of an assembly of modular components.

19 Claims, 11 Drawing Figures

Fig. 1
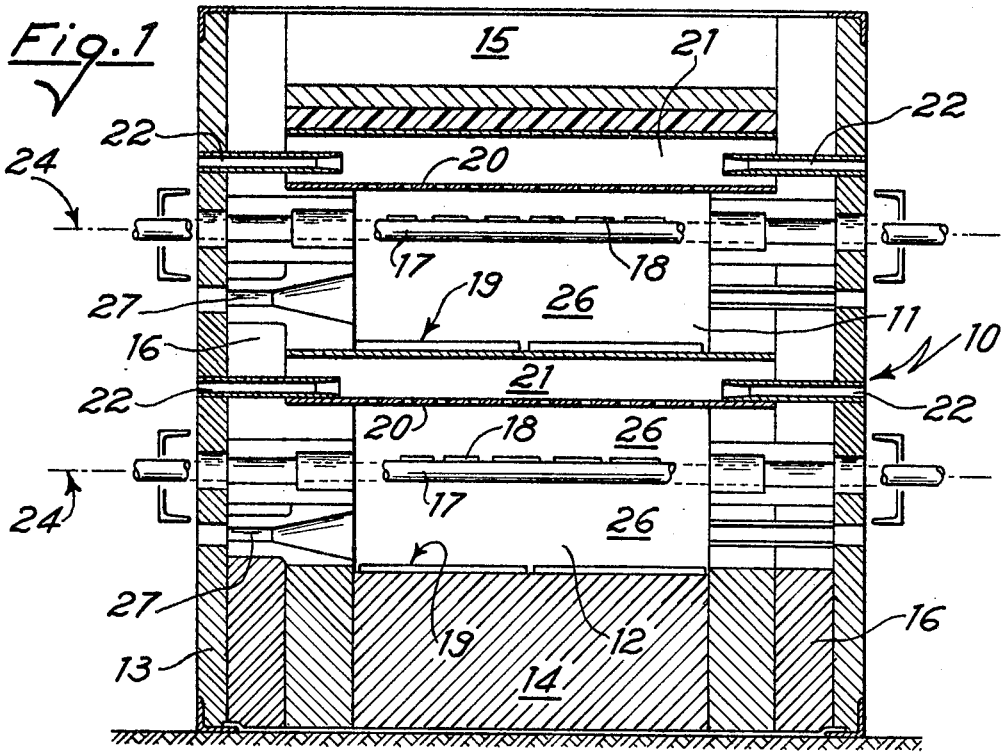
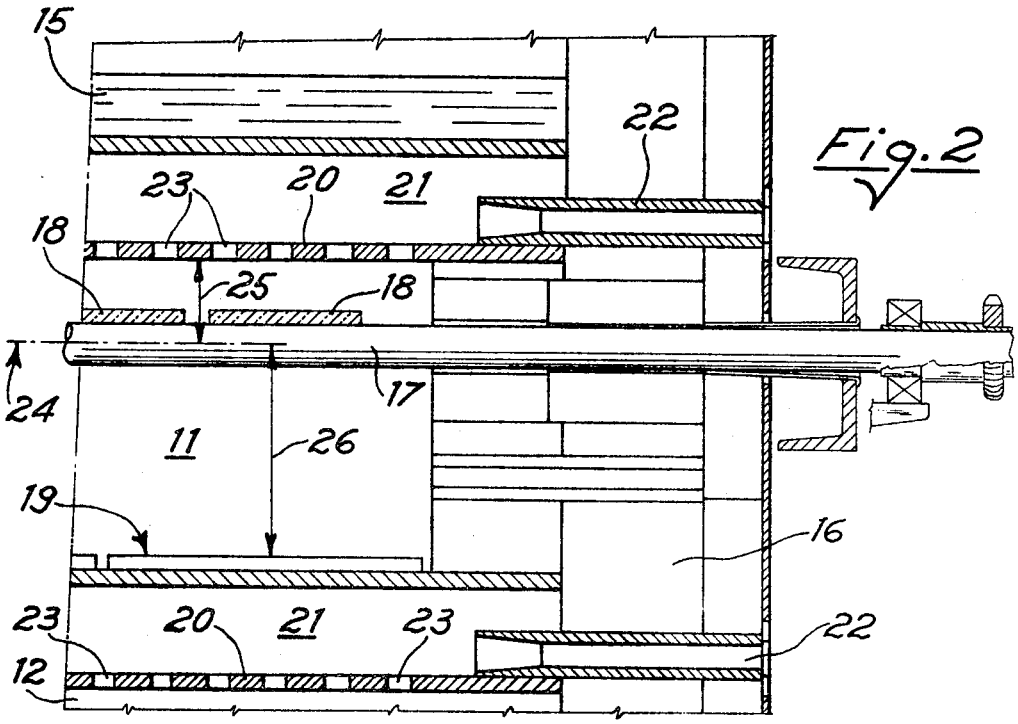
Fig. 2

OVEN FOR FIRING CERAMIC MATERIALS, HAVING HIGH THERMAL EFFICIENCY

BACKGROUND OF THE INVENTION (a) The Field of the Invention

This invention refers to an oven for firing ceramic materials, which oven has a high thermal efficiency and has other original and advantageous structural and operational characteristics which will appear from the description thereof.

The ceramic materials in question are mainly tiles for flooring, wall coverings, and the like, but the invention is not limited thereto and is applicable to ceramic materials different from tiles, provided that they may be processed in the apparatus according to the invention.

(b) The Prior Art

It is known to fire ceramic materials, in particular tiles, by various processes and various types of apparatus. Not considering all the operations and devices which are not connected with the firing stage to which the invention refers, and thus not considering the mechanical formation of the tile bodies, the application of the glaze thereto, their drying, their transport or storage, the loading and unloading operations, etc., it may be recalled that the firing of tiles is carried out mainly according to the two stage or to the single stage processes. In the first case the ceramic tile body is fired firstly without the glaze coating, whereby the so-called "bisque" is produced, and subsequently the bisque is covered with glaze and the glaze is fired and vitrified in turn. In the single stage firing process, on the contrary, the raw tile body is coated with liquid glaze and the whole is fired in one operation. The invention herein to be described is independent of the particular process employed, inasmuch as it is applicable both to the firing of ceramic bodies and to the firing of the glaze on the bisque, as well as to the single stage firing of raw ceramic bodies already coated with glaze.

Further, the invention is independent from the particular compositions both of the ceramic body and of the glaze, and is therefore independent from the particular thermal diagram which it is desired to follow in the firing, in each specific case. As is known, it is customary to introduce into the firing ovens the raw tile or tile body or the bisque with the raw glaze (and since there is no need, as far as this invention is concerned, to distinguish between these various cases, the word "tile" will always be used to refer miscellaneously to all of them) in a dried condition and therefore at a temperature above room temperature but not very high, as e.g. about 100°-300° C., and to heat it in a first section of the firing oven, with a heating rate which depends on many factors, both chemical and mechanical, and which varies from case to case, until it has been brought to temperatures which are very close to the maximum firing temperatures. Thereafter the heating proceeds generally more slowly, the temperature curve flattens out at a certain point—and may even show a maximum, though not a sharp one, and then slope down slightly—all this in a firing zone appear. A lowering of the temperature, optionally a fairly sharp one, follows before the tiles leave the oven, due to a direct or indirect cooling to which it is convenient to subject the tiles in the end zone.

A first distinction between various known processes and corresponding apparatus, consists in the different mechanical means used for advancing the tiles along the oven. In some apparatus— more properly called "tunnel ovens"—the tiles are loaded onto trucks or other supports, each of which carries a plurality of tiles, and then the trucks or supports are caused by any suitable means to travel through the oven at the desired speed. In other types of ovens, the tiles are advanced, it may be said, individually, i.e. are individually deposited onto conveyors and in theory should all move along the oven at the same speed, and therefore maintain without change the mutual position resulting from their loading. In case of failures which may always occur, such as tile breakage, blocks, and the like, means must be provided, and are provided in different ways in the various apparatus, for re-establishing the regular flow of the tiles.

SUMMARY OF THE INVENTION

This invention refers to the second aforesaid type of process and apparatus, inasmuch as the tiles are individually conveyed along the oven. The conveying means preferably adopted, and with reference to which the invention will be described, includes a plurality of rotating rollers on which the tiles are supported and by which they are advanced at a speed corresponding to the peripheral speed of the rollers. However this is not an absolute limitation of the invention, since this latter may be carried into practice by using any conveyor that permits the tiles to be heated substantially on both faces, as will be better explained hereinafter.

In the process and apparatus according to the invention, the tiles travel in a plurality of channels which are superimposed and substantially equivalent to one another from the processing viewpoint, although of course they may have constructional differences due to their different positions. The number of channels which will be shown in the description of the invention, is merely an example and may be changed as desired. It is also possible to associate several channels laterally as well as in superimposed relationship, without exceeding the scope of the invention.

Considering each channel separtely, according to the invention the axis of each tile conveyor roller is not located in the channel symmetrically, i.e. at half the height of the channel, but rather the depth of the channel below the axis is different from its height above the axis, and specifically, the axis is closer to the ceiling than to the floor of the channel. Preferably, the distance of the roller axes from the channel floor is not less and preferably is greater than twice the pitch of the rollers, wherein the word "pitch" means the horizontal distance between the axes of any two adjacent rollers. Still more preferably, the distance of the roller axes from the channel floor is not greater than twice the pitch of the rollers plus the diameter of the rollers.

Preferably, also, the distance of the roller axes from the ceiling of each channel is not greater than the roller pitch, and still more preferably is slightly smaller, e.g. 1-2 mm less, than the pitch.

According to an embodiment of the invention, the superimposed channels which constitute the oven, each consist of a plurality of chambers set side by side, separated by partitions, and the rollers extend from one side of the channel to the other through the chambers, without engaging the partitions, sufficient play being left between the rollers and the openings in the partitions through which the rollers pass, to permit the orientation of the rollers to be adjusted.

The tiles are heated by a combination of heat transfer mechanisms, which may vary in different embodiments of the invention. In one embodiment, heat is radiated from the ceiling of each channel and hot gases are directed from the ceiling onto the tiles, though of course the gases spread out in various directions and with local turbulences in the channel, and in the channel portion below the rollers, heating occurs by radiation from the channel floor and by convection, including what may be called "open flame" convection, due to combustion products fed into the channel directly by the burners which produce them, the burners however not being in sight of the tiles, so that in general there is no significant heat transmission by radiation directly from the burners to the lower faces of the tiles.

In another embodiment of the invention, each pair of vertically adjacent and superimposed channels is separated by a hollow slab which defines a plurality of cavities between the channels, to which cavities the fumes produced by burners which heat the oven, are conveyed, the slabs being provided with ports for the outlet of the fumes both upwards, where the slab constitutes the floor of the upper channel, and downwards where it constitutes the ceiling of the lower channel.

In a preferred variant of this embodiment, the slab defines a plurality of cavities which are transversal with respect to the longitudinal axis of the oven, and which are of at least two types, alternating as one proceeds longitudinally along the oven, one type of cavity being provided with downwardly directed ports and the other type being provided with upwardly directed ports, a plurality of cavities of both types being preferably provided in each one of a plurality of elements which together make up the slab, the cavities each being fed with hot fumes from a separate burner.

In a further embodiment of the invention, the mutually superimposed channels of the oven are separated by slabs wherein electric resistance heating elements are housed, similar slabs being preferably provided above the uppermost channel and below the lowermost channel, the surfaces of the slabs constituting radiating surfaces for heating the tiles or other materials travelling through the oven, by radiation.

The speed of rotation of the rollers and the speed of travel of the tiles, are preferably varied at at least one point, by increasing them slightly in the direction of travel of the tiles.

Preferably the oven heating means are maintained in operation when the oven is temporarily stopped, but with decreased intensity so as to maintain the oven channels, in the absence of products travelling through them, at a high enough temperature to permit their being brought rapidly to regime temperature when operation of the oven is resumed.

BRIEF DESCRIPTION OF THE DRAWINGS

The invention will be better understood from the following description of a number of non-limitative embodiments, with reference to the accompanying drawings, wherein:

FIG. 1 is a transverse cross-section taken or a vertical plane, of an oven according to one embodiment of the invention;

FIG. 2 is an enlarged detail of FIG. 1;

DETAILED DESCRIPTION OF THE INVENTION

Figure 3:
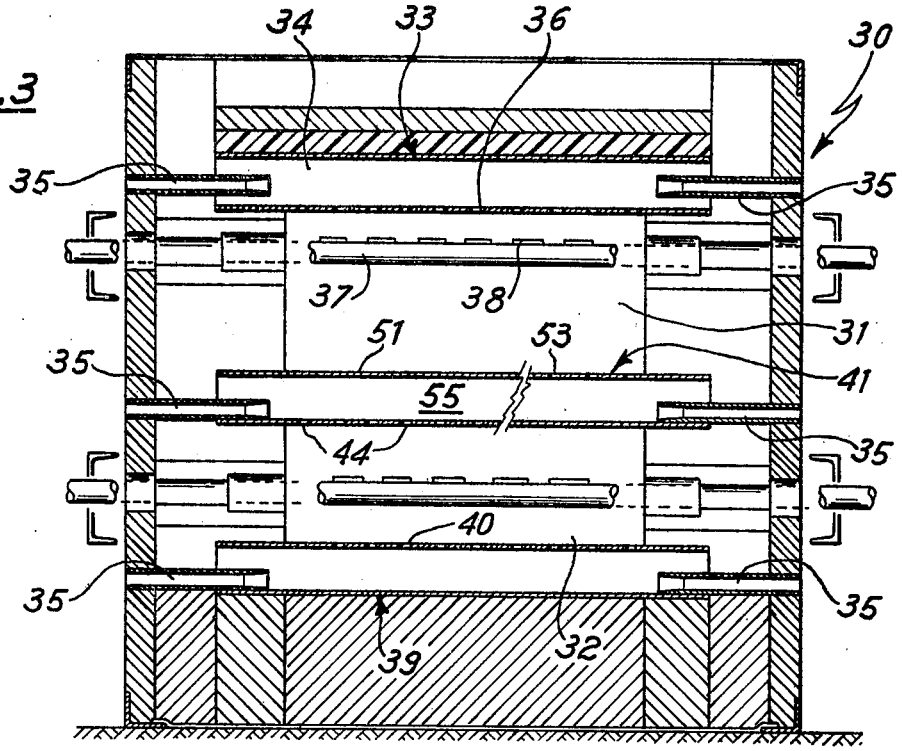
FIG. 3 is a transverse cross-section of an oven according to another embodiment comprising two superimposed channels, the oven being heated, in this embodiment, by combustion gases which are introduced into cavities provided in slabs above and below each channel.

Referring now to FIGS. 1 and 2, numeral 10 generally indicates the oven which, in this embodiment, has only two channels, upper channel 11 and lower channel 12. As has been already said, the number of channels could be greater, and actually in most practical cases will be three or even more, but only two channels have been shown herein to simplify the illustrations. The oven is provided with a support structure, e.g. constituted by suitably connected metal profiles, generally indicated at 13, which is not described as it is not a part of the invention and may therefore be made in any convenient way. Both the bottom 14 of the oven and its roof 15, as well as the sides 16, are suitably insulated and are made in any convenient way, particularly by using a modular structure which makes it easy to construct ovens of different dimensions from standard components.

Rollers 17 for supporting and advancing the tiles are provided in each channel, such rollers passing through the walls of the oven channel and being supported and actuated in any convenient manner. The tiles 18 lie on the rollers.

As illustrated in the drawings, the axes of the rollers are not located at half the height of each channel. Each channel is provided with a floor 19 which defines together with the ceiling 20 of the underlying channel (except of course for the bottom channel) a cavity 21. Heating gases are conveyed into the cavity 21. Such gases might flow e.g. from a central installation through distribution pipes, or might flow from a group of installations relative each to a longitudinal section of the oven. In a preferred embodiment, herein illustrated, the gases originate from a plurality of small burners 22 fed with fuel gas e.g. hydrocarbon gas, such as methane, and combustion air, by means of known devices which need not be described, the operation of the burners, however, having certain features which will be set forth hereinafter.

Each ceiling is provided with ports 23, so that the combustion fumes from burners 22, creating a slight pressure in the cavities 21, not only heat the cavity itself, but flow out through ports 23 forming jets directed towards the tiles, and impinge on the tiles, and because ports 23 are close to the ceiling as will more fully set forth, heating the tiles. Concurrently the gases tend to flow longitudinally along the oven, because the whole oven, as will be better explained, is filled with a fluid stream flowing on the average in a longitudinal direction from the zone of the tile outlet from the oven to the zone of the tile inlet thereinto. The space between the lower surface of the ceiling 20 and the plane 24 on which the roller axes lie, is indicated in the drawings by numeral 25, whereas numeral 26 indicates the space from plane 24 to the floor 19 of the channel.

In this embodiment heating gases are also conveyed to space 26, said gases originating from burners 27 which may be similar to burners 22 but which are housed in the oven walls 16 so that their flames are not in view of the tiles, but the combustion gases flow freely from the burners and directly penetrate into space 26. In this case too the individual burners might be replaced by a centralized installation or by a number of installations servicing different sections of the oven.

In carrying out the invention structural prescriptions must be followed which have no parallel in known apparatus. It has already been noted that the rollers are positioned asymmetrically in the channels. On the other hand the rollers are spaced from one another and their pitch—defined as the horizontal distance between the axes of any two adjacent rollers in each channel—is uniform along the entire oven or at least along a prevalent part thereof.

The height of the zone 26, i.e. of the lower part of the channel, or in other words the distance between the plane 24 of the roller axes and the upper portion of the floor 19 of each channel, should be at least equal to twice the roller pitch and should preferably be greater, and still more preferably should be equal to at least twice the roller pitch plus the roller radius and comprised between this last value and twice the roller pitch plus the roller diameter. Values equal to twice the roller pitch plus 24–25 mm are particularly preferred. There is no upper limit to the distance from the plane 24 to the upper surface of the floor 19, in the sense that if that distance is increased above the aforesaid values, the oven will still be functional. However any substantial increase above the above values cannot give rise to any adavantages and causes a drop in the thermal efficiency of the oven.

The height of the upper part 25 of each channel, i.e. the distance from the plane 24 to the lower surface of the ceiling 20, should be less than the distance from the plane 24 to the upper surface 19 of the floor, as hereinbefore defined, and preferably should not be greater than the pitch of the rollers. Such height is preferably not significantly less than the pitch of the rollers and generally is not less than twice the diameter of the rollers. An optimal value is 1–2 mm less than the pitch of the rollers.

In the embodiment described the heating of the tiles occurs, as has been stated, partly by radiation from the floor and the ceiling and partly by convection. At any rate, it is necessary to precisely control the process, from the thermal viewpoint, section by section, along the longitudinal extension of the oven, and to this end, the temperature of the gases introduced directly into the channels or into the spaces between the ceiling of a channel and the floor of the channel aoove it, should be controllable and variable at any instant. This may achieved by known means, more or less precisely, through a modulation of the control of the heat sources which produce the hot gases. The modulation devices required to this end are generally relatively complicated and costly. The preferred heating system described in this embodiment makes it possible to solve the same problem economically. The solution is based on a distribution of the heating which may be called "capillary", i.e. on the provision of a large number of low power burners, easily controllable one by one, as will presently be explained. For instance, one burner may be provided for each side of each combustion chamber and for each 20 cm of longitudinal extension thereof, to feed the cavity above the ceiling of each channel, and an equal, or if desired smaller, number of burners to feed the space of each channel below the conveyor rollers. The burners may be fed e.g. with methane and burn a few tenths, e.g. two tenths, of a cubic meter of methane per hour.

The control is effected simply by varying the amount of gas fed to any burner, while the amount of air fed thereto remains constant. Obviously under such conditions the excess of air changes. When a greater amount of heat is required, the amount of gas is increased and this causes the excess of air to decrease and the flame obviously becomes less oxidizing. For instance, the excess of air may be, in a typical case, 30% under regime operating conditions and may decrease down to 10% when the request of heat is at a maximum. Under such conditions the flame always remains sufficiently oxidizing and the amount of heat supplied varies within the desired limits in each case, the control being effected merely by means of bypass electro-valves, whereby a constant feed of a base fuel-air mixture is always maintained, and when it is needed, the required additional gas is drawn from the electro-valve. It is not necessary to graphically illustrate this system, as it can be easily carried into practice by persons skilled in the art, and as it is, in itself, a known system.

In a specific, non-limitative example of a firing oven for tiles having sizes from 15×15 cm and 4.5 mm thickness, to 20×20 cm and 10 mm thickness, rollers having a diameter of 30 mm and a pitch of 74 mm were used. The distance from the plane of the roller axes to the upper surface of the floor of each channel is 172.5 mm and the distance from such plane to the lower surface of the ceiling of each channel is 72.5 mm.

The rollers are supported and driven in any convenient manner.

By way of example, the ports in the ceiling 20 of each channel may have a diameter of 12–20 mm and be arranged in a reticular pattern having a side of about 30–50 mm.

As has already been mentioned, although the heating gases are introduced laterally into the oven and flow laterally or downwards and/or in local vortices, there is a global gas flow in the direction of the oven length and substantially countercurrent to the direction of movement of the tiles. This may conveniently be produced by a drawing chimney located near the tile inlet zone of the oven arrangement, which is known in ovens for ceramic materials. As is also know, it is desirable that the balance of the aspiration and of the inlet of gases in the firing space be such that a superatmospheric pressure always be maintained in the space, such pressure however being extremely small and in the order of a few millimeters of water. The longitudinal flow, besides having desirable effects on the heat exchange, the cleanliness of the oven surfaces, etc. also has the function of making it possible to exploit the heat content of the tiles which have reached the end of the firing zone. At the end of this zone, a direct cooling of the tiles occurs due to the introduction of a stream of air which is cold or at least at a temperature that is considerably lower than that of the tiles, this being an operation known per se in tile firing ovens. This air stream removes heat from the tiles, and since it is drawn inside the oven, causes the heat to be recovered. It is desirable to recover the heat as fully as possible, yet excessively cold air should not be introduced into the oven. A further cooling of the tiles may be effected indirectly, e.g. by placing in the end section of the oven coils within which a cooling fluid circulates, but this is an accessory device the adoption of which should preferably be kept to a minimum.

Figure 4:
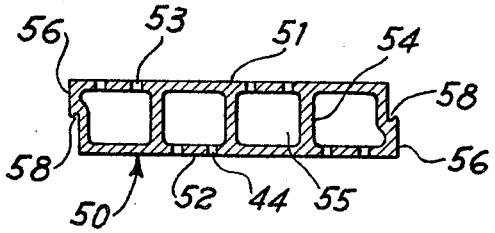
FIG. 4 is a transverse cross-section of one of the plates which make up such slabs.
Figure 5:
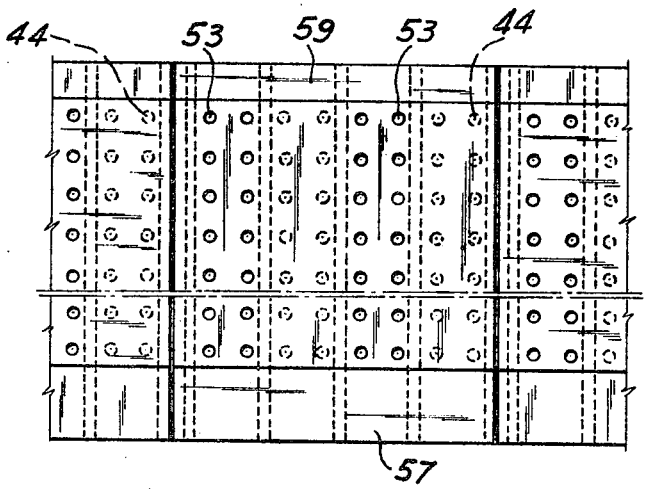
FIG. 5 is a fragmentary plan view of a slab constituted by the joining of elements like that illustrated in FIG. 4.

With reference now to FIGS. 3 to 5, there is illustrated another embodiment of the invention. The oven illustrated is made up of two superimposed channels, but of course, as in all embodiments, the number of channels could be greater, e.g. could be three. The oven in question comprises a brickwork generally indicated at 30 and comprises an upper channel 31 and a lower channel 32. Above the upper channel 31, a slab 33 is mounted, which creates a cavity 34, into which burners 35 feed hot gases which thereafter flow out through ports 36. In the oven chambers such as chamber 32, rollers 37 are located, which support and advance the tiles 38, and which may be identical to those of the previously described embodiment.

A slab generally indicated at 39 is mounted below channel 32, this slab being similar to slab 33 but turned—so to speak—upside down, and being fed by burners 35 but provided with ports 40 directed upwards. Between the two channels there is mounted a slab generally indicated at 41 which defines a cavity or, better, a plurality of cavities 55 also fed with hot gases from burners 35. Slab 41 however is provided both with downwardly directed ports and with upwardly directed ports, but since these two kinds of ports are never found concurrently on the same transversal plane, as will presently appear, slab 41 is shown partially in cross-section on a vertical plane wherein the ports are directed downwards and partially in cross-section on a plane wherein the ports are directed upwards.

How this occurs, will be understood from an inspection of FIG. 4 which shows a cross-section of a plate 50 which is the basic component of slab 41. It is seen that this plate, generally indicated by the numeral 50, is constituted by two parallel faces 51 and 52 and by intermediate ribs 54 which define a plurality of cavities 55, of which four are indicated herein by way of example. It is also noted that the plate is provided, on two diagonally opposed edges, with two projections 56 and two depressions 58 having a shape corresponding to that of the projections. Further, the plates comprises two zones 57 and 59 without apertures, having the same length or different lengths, disposed at the two longitudinally opposed ends of the plate.

The two faces 51 and 52 are provided with upwardly directed ports 53 and with downwardly directed ports 44, respectively, each cavity 55 having either the one or the other type of ports, and the two types of ports being alternated. Since the cross-sectional plane of FIG. 4 is parallel to the longitudinal axis of the oven, it is obvious that the slab 41 will have rows of upwardly directed and rows of downwardly directed ports, in succession. In each cavity 55 a burner penetrates and feeds hot gases thereinto, which gases therefore flow both into the overlying and into the underlying oven channels. It is preferred, but not necessary, that the burners which feed the overlying channel be on one side of the oven and those which feed the underlying channel be on the other side thereof.

The plates 50 form a continuous slab because the projections 56 of each of them engage the depressions 58 of the adjacent plate.

Figure 6:
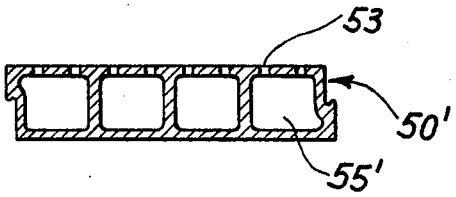
FIGS. 6 and 7 are a transverse cross-section and a plan view, respectively, of another plate.
Figure 7:
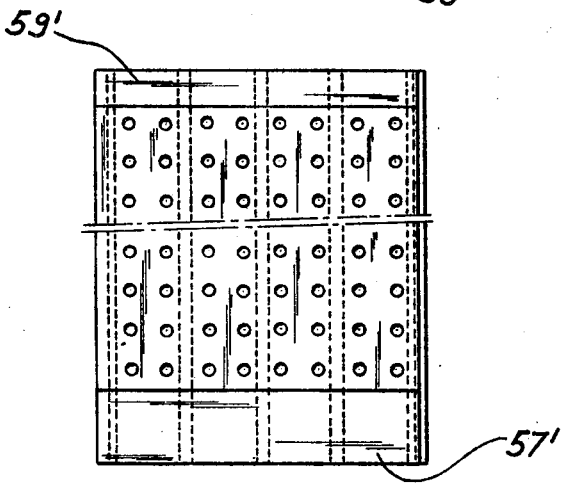

FIGS. 6 and 7 illustrate a plate 50' similar to plate 50 but having all the ports—herein indicated by numeral 53—directed upwards, and having zones 57' and 59' without apertures. A succession of such plates constitutes the slab 39, i.e. the floor of the lowermost oven channel. The cavities 55' also are fed by burners 35.

An identical plate serves to make up the ceiling 33 of the uppermost channel and has not been illustrated as it would look like that of FIG. 6, but turned upside down.

Many variations can be made in the slabs. An intermediate slab 41 could be constructed, e.g., with groups of rows of ports alternatively directed upwards and downwards. Differently shaped plates could also be made, with respect to the cavities which they define, or to the number of cavities, or to the partitions which separate one cavity from another, or to the external shape of the plate, and various types of plates could be employed to make up a slab or several slabs.

Figure 8:
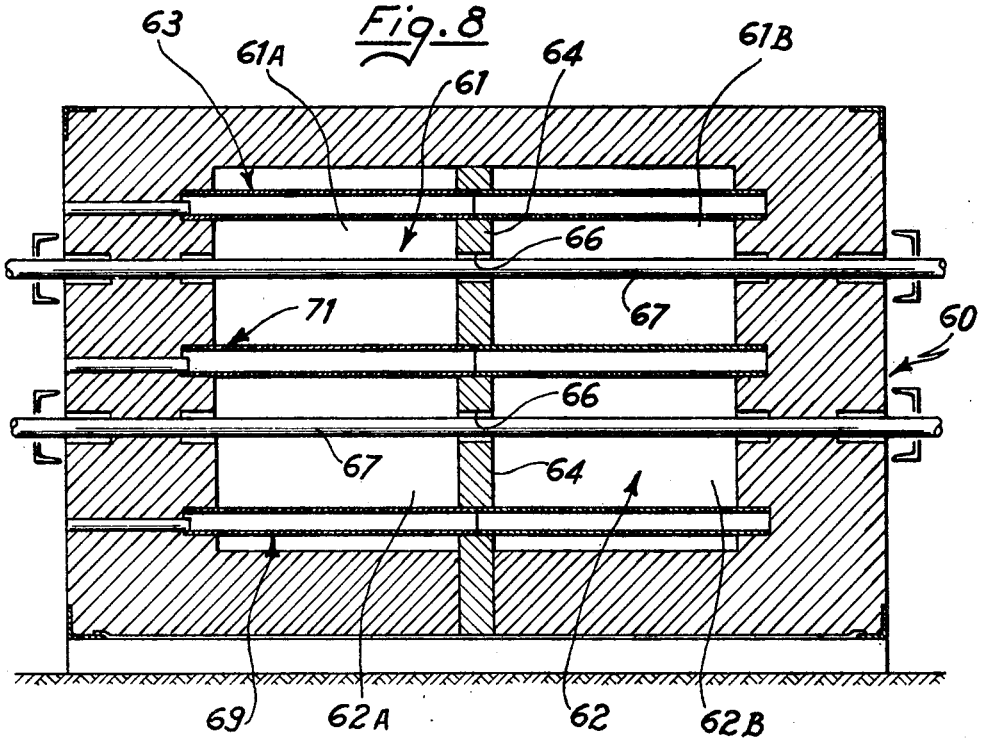
FIG. 8 is a transverse cross-section of an oven according to a further embodiment, wherein each channel is constituted by two chambers arranged side by side.

FIG. 8 is a cross-section similar to that of FIG. 3, illustrating an oven according to a further embodiment of the invention. Herein also the oven has been shown as having two superimposed channels, but the number of channels could be three or more. In this embodiment, the oven is supposed to be heated electrically, as will be described hereinafter in greater detail, and therefore there are no ports for the introduction of gases either on the floor or on the ceiling of the channels. The oven comprises a brickwork generally indicated at 60 and the channels are indicated at 61 and 62. The uppermost slab 63, the lowermost slab 69, and the intermediate slab 71, are without apertures.

It is clear however that here too the oven could be heated by gases and the slabs could be made as in the embodiment illustrated in FIG. 3 and be fed by burners, the type of heating and the other features of the oven except those which will now be pointed out, being irrelevant with respect to the variant which this embodiment is intended to illustrate, as will presently appear.

Each channel is divided into two halves arranged side by side, and thus channel 61 comprise two chambers 61A and 61B, and channel 62 comprises two chambers 62A and 62B. The chambers constituting each channel could of course be more than two, i.e. could be three or more. The brickwork 60 however is common to all the chambers, and the chambers of each channel are separated from one another by partitions indicated at 64, provided with apertures 66 through which the rollers 67 pass. Partitions, apertures and rollers are generally identical in the two channels, but they could be different.

Figure 9:
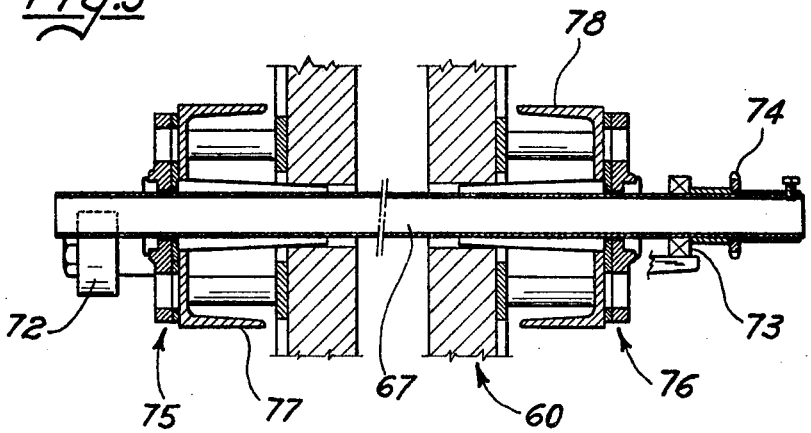
FIG. 9 is a schematic illustration of the supports of the rollers of the oven illustrated in FIG. 8.

The diameter of rollers 67 is smaller than that of apertures 66 so that a significant play is left between rollers and apertures, and no support is provided in the partitions 64. The rollers are supported only at the two ends, and otherwise extend without intermediate supports through all the chambers. The manner in which the rollers are supported at their ends, is not a part of the invention, but is illustrated for the sake of clarity in FIG. 9. On one side (the left side in the drawing) the roller 67 bears on two small support cylinders 72 (only one of which is visible in the drawing). On the other side the roller is supported by a bearing 73 and is driven through a toothed wheel 74. Assemblies 75 and 76, of any convenient structure, supported by members 77 and 78 which are a part of the framework of the oven, assure the airtightness of the brickwork at the inlet and outlet of the rollers.

The fact that the rollers are not supported in the partitions which divide the laterally adjacent chambers which constitute each channel, would appear to be irrational and harmful and would be held to be so according to the state of the art, since it has always been believed that the rollers can only have a very limited free length within the hot processing space defined by the oven channels, if harmful bending is not to occur, and at any rate it could not be anticipated that any advantage would derive from the absence of supports. It has surprisingly been found that on the one hand the absence of intermediate supports does not cause any damage, as the rotation of the rollers suffices to prevent their permanent bending, and that on the other hand, the absence of intermediate supports makes it possible to eliminate a very serious drawback which otherwise would be inevitable and very severe, i.e. it makes it possible to avoid that the tiles deviate from a trajectory that is exactly parallel to the longitudinal axis of the oven.

It is clear that it is desirable that the tiles should follow a perfectly longitudinal path, since in this case they may be laid onto the rollers very close to one another and can occupy the entire width of the channels, whereby the oven is fully exploited. Such an exploitation was not possible in the preceding art because it was not possible to obtain a perfectly longitudinal trajectory of the tiles, which tended to deviate towards one or the other side, so that it was necessary to leave, between adjacent tiles and between the tiles and the walls of each treatment chamber, a certain space sufficient to absorb the lateral deviations of the tiles without causing contact between different tiles and between the tiles and the walls, which would have produced disastrous results as it would have led to jams and interruptions of production.

It has been found that this can be avoided by an adjustment of the orientation of the axes of the rollers, effected while the oven operation is checked after the oven has been assembled. Very slight angular displacement of the roller axes, obtained through an exact calibration of the position of the supports, makes it possible to avoid any deviation from a rectilinear path of the tiles. This can be done provided that the rollers are free to become displaced within the entire channel and are supported only at their ends, and this is permitted according to the present invention, by the absence of intermediate supports and by the existence of a play between each roller and the apertures of the partitions through which the roller passes.

Another constructional feature will now be described with reference to FIGS. 10 and 11. These refer to the structure of the slabs above and below the channels and between superimposed channels, in an electrically heated oven, such as e.g. that illustrated in FIG. 8. These slabs also are conveniently made up of plate-like components similar to those previously described with reference to FIGS. 4 and 5, but these plate-like components are intended to constitute radiating plates and do not receive in their cavities fumes from burners, but rather house heating resistances.

Figure 10:
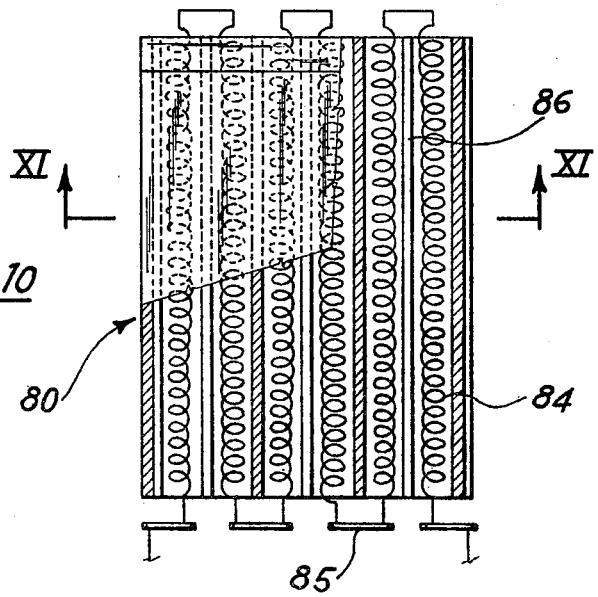
FIG. 10 is a partial horizontal cross-sectional view of an element of an oven slab according to a still further embodiment of the invention, wherein the oven is heated electrically.
Figure 11:
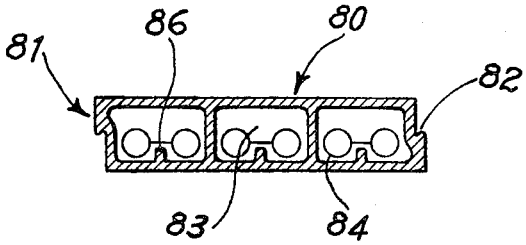
FIG. 11 is a cross-section of the plate of FIG. 10 taken on the plane XI—XI of FIG. 10, looking in the direction of the arrows.

In FIGS. 10 and 11 the plates are generally designated by the numeral 80. They have a parallelepipedal cross-section, provided with projections 81 corresponding to projections 56 of FIG. 4 and depressions 82 corresponding to depressions 58 of FIG. 4. Cavities 83 are defined in the plates and resistances 84 are housed therein. The resistances are preferably U-shaped and the terminals 85 connect them to adjacent resistances or to circuit terminals. The plates are conveniently shaped in such a way that a rib 86, which serves to keep the two branches of each resistance 84 separate, is present in each cavity 83.

According to a preferred feature of the invention, as has already been mentioned, and in any embodiment, the tile supporting and advancing rollers may be actuated with speeds which are not identical along the oven, and preferably the speed is slightly increased at least about the middle of the oven, which has been found to be advantageous in preventing jams. The speed increase may be in the order of a few units percent.

Further, the oven may also be conveniently operated discontinuously, by providing means for controlling the burners, or other heating means, during the stoppages, in such a way that the heat supplied to the oven will be sufficient to maintain the mass of the oven close enough to the firing temperature, so that at the moment the oven operation is started again, the oven may be quickly brought up to regime temperature. If the oven is heated by means of combustion gases, the fumes may be drawm off from one end of the oven, as is done during normal operation, but much more slowly. The heat consumed by the oven under such conditions is low enough, since on the one hand there is no cooling due to the entrance of material to be fired, and on the other the amount of excess air which is drawn off to maintain the desired atmosphere in the oven during operation, is missing.

While a number of embodiments have been described, many modifications and variations thereof are possible without departing from the scope of the invention.

I claim:

1. An oven for firing ceramic materials, particularly ceramic tiles, said oven comprising:

a plurality of superimposed, longitudinally extending oven channels, each said channel being defined by insulated lateral walls, by a floor and by a ceiling;

means for heating said channels;

each said channel having extending transversely thereacross a plurality of rollers uniformly spaced from each other in the longitudinal direction of said channel, at least throughout a major portion thereof, thus forming means for supporting and advancing ceramic materials through said channel; and said rollers of each respective said channel being positioned therein at a single level closer to the ceiling than to the floor of each respective said channel.

2. An oven as claimed in claim 1, wherein the distance of the axes of said rollers from said floor of the respective channel is not less than twice the pitch between adjacent said rollers.

3. An oven as claimed in claim 2, wherein said distance of said axes of said rollers from said floor of said respective channel is greater than twice said pitch between adjacent said rollers.

4. An oven as claimed in claim 2, wherein said distance of said axes of said rollers from said floor of said respective channel is not greater than twice said pitch between adjacent said rollers plus the diameter of said rollers.

5. An oven as claimed in claim 1, wherein the distance of the axes of said rollers from said ceiling of said respective channel is less than the distance thereof from said floor of said respective channel and is not greater than the pitch between adjacent said rollers.

6. An oven as claimed in claim 5, wherein said distance of said axes of said rollers from said ceiling of said respective channel is 1–2 mm less than said pitch between adjacent said rollers.

7. An oven as claimed in claim 1, wherein said superimposed channels are each constituted by a plurality of laterally juxtaposed chambers separated by partitions, said rollers extending transversely of each said channel from one end thereof to the other end thereof, through the said chambers thereof, without engaging said partitions, sufficient play existing between said rollers and said partitions to permit adjusting the orientation of said rollers.

8. An oven as claimed in claim 1, wherein said heating means comprises a plurality of burner means housed in said lateral walls of each said channel for feeding hot gases to cavities defined above said ceiling of each said channel and to the zone of each said channel defined between said rollers and said floor thereof.

9. An oven as claimed in claim 1, wherein each vertically adjacent and superimposed pair of said channels are separated by a hollow slab positioned between said pair of channels and defining the floor of the uppermost of said pair of channels and the ceiling of the lowermost of said pair of channels, said slab having extending therethrough a plurality of cavities, said heating means comprising burners, said cavities receiving fumes produced by said burners, said slabs having therein first ports for the outflow of the fumes upwardly through said floor of said uppermost of said pair of channels, and second ports for the outflow of the fumes downwardly through said ceiling of said lowermost of said pair of channels.

10. An oven as claimed in claim 9, wherein said plurality of cavities extend transverse with respect to the longitudinal axis of the oven and comprise different first and second types of cavities, alternatively arranged longitudinally of the oven, said first type of cavity being provided with said second, downwardly directed ports, and said second type of cavity being provided with said first, upwardly directed said ports, said slab comprising a plurality of connected components, each said component having therein a plurality of said cavities.

11. An oven as claimed in claim 10, wherein each of said components has therein a plurality of cavities of both said first and second types.

12. An oven as claimed in claim 10, wherein said heating means comprises a separate said burner for each said cavity.

13. An oven as claimed in claim 9, wherein the ceiling of the uppermost said channel of the oven and the floor of the lowermost said channel of the oven each comprise hollow slabs defining therein cavities provided with outflow ports only on the surface facing toward the respective said channel.

14. An oven as claimed in claim 13, wherein said slabs defining said ceiling of said uppermost channel of the oven and said floor of said lowermost channel of the oven comprise identical plate-like components which are oppositely oriented.

15. An oven as claimed in claim 12, wherein said burners which feed said first type cavities are located at a first lateral side of the oven, and said burners which feed said second type cavities are located at a second lateral side of the oven.

16. An oven as claimed in claim 1, wherein said heating means comprise a relatively high number of heating burners of relatively low power, normally fed with a mixture of fuel and air in a predetermined ratio, and means being provided for feeding thereto an additional amount of fuel, when required, without varying the amount of air.

17. An oven as claimed in claim 1, wherein said heating means comprise means for heating the ceramic materials by radiation and comprising hollow slabs above and below said channels and housing therein electric resistance heating elements.

18. An oven as claimed in claim 1, further comprising means for driving said rollers at different speeds in different longitudinal sections of the oven.

19. An oven as claimed in claim 1, wherein said heating means include means for heating said channels at a reduced rate during periods in which the oven is not operative and for reducing the longitudinal flow of gases through the oven during such periods.

* * * * *